United States Patent [19]

Jett, Jr.

[11] Patent Number: 4,682,545

[45] Date of Patent: Jul. 28, 1987

[54] AMMUNITION ROUND

[76] Inventor: Thomas M. Jett, Jr., P.O. Box 167-B, R.R. 3, Litchfield, Ill. 62056

[21] Appl. No.: 862,698

[22] Filed: May 13, 1986

[51] Int. Cl.[4] ..... F42B 5/02

[52] U.S. Cl. ..... 102/430; 102/439; 102/444; 102/469; 102/501

[58] Field of Search ..... 273/428; 102/430, 444–447, 102/464, 469, 501

[56] References Cited

U.S. PATENT DOCUMENTS 3,861,308 1/1975 Grandy ..... 102/430
4,005,660 2/1977 Pichard ..... 102/501

FOREIGN PATENT DOCUMENTS 1229419 11/1966 Fed. Rep. of Germany ..... 102/447
16230 of 1884 United Kingdom ..... 102/446
2075155 11/1981 United Kingdom ..... 102/430

*Primary Examiner*—Harold J. Tudor
*Attorney, Agent, or Firm*—Polster, Polster and Lucchesi

[57] ABSTRACT

An ammunition round for a small arms piece including a cartridge casing with a nose opening and base opening at opposite ends thereof and a casing defined internal chamber extending therebetween with the nose opening serving to snugly receive a pellet means and the base opening serving to snugly receive a primer means, the nose opening corresponding in cross-section with the original bore of the barrel of the small arms piece, the casing having an internal protruding displacement extending into the internal chamber adjacent the nose opening to provide a stop seat for the pellet means.

3 Claims, 4 Drawing Figures

AMMUNITION ROUND

BACKGROUND OF THE INVENTION

The present invention relates to firearms ammunition and more particularly to an ammunition round for a small arms piece adapted to firing for practice shooting, target shooting and training usage.

It is known in the firearms art to adapt a firearm for practice shooting, target shooting and training usage by reducing barrel bore caliber through a barrel liner having a reduced caliber bore and providing a companion cartridge insert having a bore corresponding with that of the barrel liner. For example, U.S. Pat. No. 4,361,093, issued to M. E. Saxby on Nov. 30, 1982, and U.S. Pat. No. 4,455,777, issued to D. G. Callies on June 26, 1984, both teach structure with such reducing caliber barrel liner and cartridge insert arrangements. For the most part, such arrangements have been comparatively complex in design, manufacture and assembly, requiring several moveable parts including barrel liners, seals therefor and cartridge inserts—often with several additional insert parts.

The present invention recognizes the importance and desirability of providing an arrangement for converting existing firearm structure into an economical but yet reasonably accurate firearms piece usable for practice, target and training purposes with a minimum of parts and conversion steps. The structure of the present invention eliminates previously required barrel liners, using the bore of the original barrel, as well as the original cartridge casings or casings of similar shape and dimensions. The structure of the present invention can be readily and economically adapted for use with various types of small arms, such as pistols, revolvers, rifles and similar devices in an efficient and economical manner without change to original barrel bore or the cartridge chamber associated therewith. In addition, the several parts of the structure can be readily, snugly and efficiently assembled for optimum performance in firing.

Various other features of the present invention will become obvious to one skilled in the art upon reading the disclosure set forth herein.

SUMMARY OF THE INVENTION

More particularly, the present invention provides an ammunition round for a small arms piece comprising: a cartridge casing having a nose opening and base opening at opposite ends thereof with an internal chamber defined by the casing extending longitudinally between the openings, the nose opening corresponding in cross-section with the original barrel bore of the small arms piece; pellet and primer means snugly disposed in the nose and base opening of the cartridge casing, the casing having an internal protruding displacement adjacent the nose opening to provide a seat for the rear end of the pellet means. The present invention includes a pellet means with a predetermined nose shape and skirt portions of sufficient thickness to withstand anticipated explosive forces thereon. Further, the present invention provides a means for sealingly engaging the wall of the primer means to minimize possibly undesirable diminishing of the explosive primer means forces.

It is to be understood that various changes can be made by one skilled in the art in the arrangement, form and construction of the apparatus disclosed herein without departing from the scope or spirit of the present invention.

BRIEF DESCRIPTION OF THE DRAWING

Referring to the drawing which discloses an advantageous embodiment of the present invention.

DETAILED DESCRIPTION OF THE INVENTION

Figure 2:
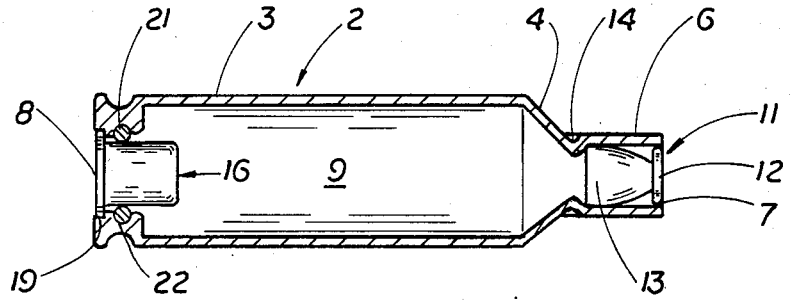
FIG. 2 is a cross-sectional view taken in plane through line 2—2 of FIG. 1 with one side of the pellet and primer being fully shown in this Figure.
Figure 1:
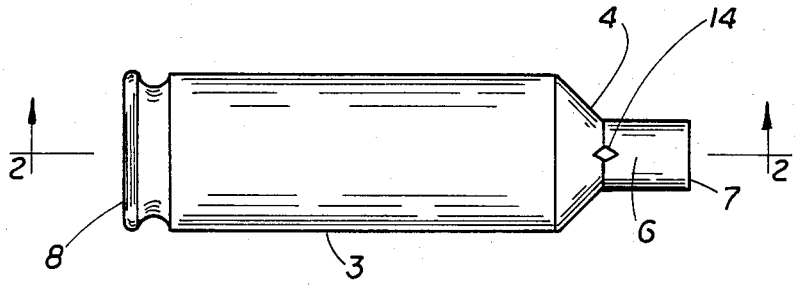
FIG. 1 is an elongated side view of the cartridge casing for an ammunition round, incorporating the inventive features.

Referring to FIGS. 1 and 2 of the drawing, the inventive ammunition round which is suitable for use for such purposes as target firing, training and practice includes an integral cartridge casing 2. The casing 2 advantageously is of brass and can be the same casing usable for ordinary firing purposes to thus minimize parts cost. Casing 2, as shown, includes a cylindrical body portion 3, an integral tapered intermediate portion 4 and an integral narrower cylindrical neck portion 6. The opposite extremities of the neck portion 6 and body portion 3 serve to define opposed nose opening 7 and base opening 8, respectively, at opposite ends of cartridge casing 2. The casing 2 defines a continuous substantially uninterrupted internal chamber 9 extending longitudinally between the nose opening 7 and base opening 8.

Figure 4:
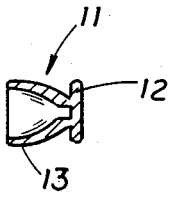
FIG. 4 is a cross-sectional view of the pellet of FIG. 2.

As can be seen in FIGS. 2 and 4, a suitable practice pellet 11 sized to be snugly inserted through nose opening 7 is provided. Pellet 11, which can advantageously be of a suitable lead material, includes a flat nose portion 12 and an integral concave skirt portion 13 extending rearwardly therefrom. It is important that these portions of the pellet 11 be of sufficient thickness to withstand the explosive forces to be exerted thereon and advantageously are of substantially uniform thickness. It is to be understood that other pellet designs can be employed, if desired. For example, the pellet design can be an independent one piece design, or the pellet can be mounted in a sabot which is then fired as a unit. The advantage of the latter approach is that the sabot can be designed for a particular caliber device while the same pellet is employed, regardless of caliber. It is further to be understood that the external surface of skirt portion 13 can be appropriately rifled if desired. The overall pellet 11 is sized in length and diameter to snugly engage within the narrow cylindrical neck portion 6 of the cartridge casing 2 with the flat nose portion 12 of pellet 11 being adjacent nose opening 7 of the casing.

In accordance with one feature of the present invention, cartridge casing 2 is provided with an internal protruding displacement extending into the chamber 9 adjacent nose opening 7. This displacement serves to provide a stop seat for the rear or aft end of skirt 13 of pellet 11. As can be seen in FIGS. 1 and 2 of the drawing, the displacement disclosed is comprised of two spaced substantially opposed displaced metal indentations 14 in the casing wall at a position adjacent the juncture of neck portion 6 and tapered portion 4 of casing 2. Thus, with a straightforward indentation step with an appropriate material displacing tool, it is possible to provide a stop seat with minimum machining operations.

Figure 3:
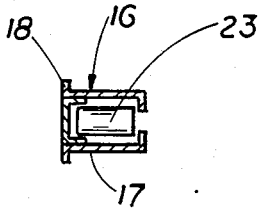
FIG. 3 is a cross-sectional view of the primer of FIG. 2.

Referring to FIGS. 2 and 3 of the drawing, a primer means 16 is disclosed as being disposed in base opening 8 at the other end of internal chamber 9 of casing 2. Primer means 16 includes a cylindrical casing 17 having a rear or aft protruding rim 18 at the trailing end thereof. Casing 2 is provided with a recessed end portion 19 which defines base opening 8 and which serves to matingly receive the protruding rim 18 of the primer casing 16. It is to be noted that, adjacent base opening 8, cartridge casing 2 is provided with a peripheral circumferential groove 21 in the internal wall thereof which serves to receive a hard rubber O-ring seal 22 therein. This seal serves to sealingly engage with the cylindrical casing 17 of primer 16 when the primer is disposed in base opening 8. Thus, when charge 23 is activated by a firing mechanism of a small arms piece (not disclosed), the exploding gases, which are designed to impel a pellet 11 at neck portion 6, are sealed from passing through base opening 8. The O-ring seal 22 also serves to ease reloading of the cartridge without requiring any expensive reloading equipment.

From the above it can be seen that the present invention can be readily and economically utilized with conventional ammunition for various types of firearms without requiring major changes to original barrels and the companion cartridge chambers associated therewith. It is to be understood that numerous variations can be made by one skilled in the art without departing from the scope or spirit of the present invention such as, but not limited to, the utilization of a sabot or a change in cartridge or pellet design.

The invention claimed is:

1. An ammunition round, comprising:

a re-usable one-piece cartridge casing including a cylindrical body portion, a tapered intermediate portion, and a narrower neck portion, said neck portion and said body portion defining a nose opening and a base opening respectively at opposite ends of said casing, said casing defining an internal chamber extending longitudinally between said opposite ends;

said base opening having a groove formed in it;

a lead pellet including a flat nose portion and an integral concave skirt portion extending rearwardly therefrom, said skirt portion being of sufficient thickness to withstand the explosive force to be exerted thereon without separation and being sized in length and diameter to engage said cylindrical neck portion of said cartridge casing snugly with said flat nose portion adjacent said nose opening of said cartridge casing, said cartridge casing having two spaced substantially opposed displaced indentations formed in said casing wall adjacent the juncture of said neck and tapered intermediate portion of said casing to provide a stop for the trailing edge of the skirt portion of said pellet; and a cylindrical primer means having a protruding rim at the trailing end thereof, said cartridge casing having a recessed end defining said base opening to receive said protruding rim of said primer means, said cartridge casing having a peripheral groove disposed in the internal wall of the body portion thereof adjacent said base opening, and re-useable resilient O-ring disposed in said groove to engage said cylindrical wall of said primer means when disposed in said base opening, said O-ring sealing said primer and said cartridge and permitting easy insertion and removal of said primer means.

2. The cartridge of claim 1 wherein said re-useable O-ring is a hard rubber material.

3. The cartridge of claim 2 wherein said pellet is lead and said cartridge is constructed from brass.

* * * * *